US005947559A

United States Patent [19]

Williams

[11] Patent Number: 5,947,559

[45] Date of Patent: Sep. 7, 1999

[54] SEATING UNIT WITH MOVABLE SEAT

[76] Inventor: James A. Williams, 1435 Walnut Rd., Galion, Ohio 44833

[21] Appl. No.: 08/708,406

[22] Filed: Sep. 4, 1996

[51] Int. Cl.[6] ..... A47C 1/02

[52] U.S. Cl. ..... 297/337; 297/342; 5/12.1

[58] Field of Search ..... 297/341, 342, 297/343, 337, 218.3, 284.11, 118, 354.12, 362.11; 5/12.1, 17, 18.1

[56] References Cited

U.S. PATENT DOCUMENTS

| | | | |
|---|---|---|---|
| 711,412 | 10/1902 | Archambeault . | |
| 871,022 | 11/1907 | Anthony | 297/342 X |
| 1,414,637 | 5/1922 | Gell | 297/343 |
| 2,025,436 | 12/1935 | Brosset . | |
| 2,351,222 | 6/1944 | Muskin et al. | 297/343 |
| 2,497,385 | 2/1950 | Cramer, Sr. | 297/342 X |
| 2,642,584 | 6/1953 | Petersen et al. . | |
| 2,860,691 | 11/1958 | Caesar | 297/218.5 X |
| 3,005,997 | 10/1961 | Fox . | |
| 3,235,308 | 2/1966 | Conner . | |
| 3,299,446 | 1/1967 | Blise et al. . | |
| 3,311,408 | 3/1967 | Sarvas | 297/218.3 |
| 3,458,877 | 8/1969 | Edwards . | |
| 3,567,280 | 3/1971 | Bradshaw | 297/343 X |
| 3,816,860 | 6/1974 | Quakenbush . | |
| 3,913,152 | 10/1975 | Quakenbush . | |
| 4,001,901 | 1/1977 | Quakenbush . | |
| 4,037,872 | 7/1977 | Quakenbush . | |
| 4,166,299 | 9/1979 | DuShane et al. | 5/18.1 |
| 4,452,486 | 6/1984 | Zapf et al. | 297/343 |
| 4,481,684 | 11/1984 | Hauck . | |
| 4,563,784 | 1/1986 | Shrock et al. . | |
| 4,586,206 | 5/1986 | Singer . | |
| 4,733,845 | 3/1988 | Maiwald . | |
| 4,756,034 | 7/1988 | Stewart . | |
| 5,098,158 | 3/1992 | Palarski . | |
| 5,292,178 | 3/1994 | Loose et al. . | |
| 5,575,449 | 11/1996 | Shinbori et al. . | |
| 5,575,535 | 11/1996 | Burchett et al. . | |
| 5,607,204 | 3/1997 | Gryp | 297/337 X |

OTHER PUBLICATIONS

Nicoletti Italia brochure, illustrating Alex Sectional, 1 page.

Print Out froom Nicoletti Italia website, www.nicolettiitalia-.com/showroom.html, 10 pages, illustrating Alex and Doge.

*Primary Examiner*—Milton Nelson, Jr.

*Attorney, Agent, or Firm*—Fay, Sharpe, Beall, Fagan, Minnich & McKee, L.L.P.

[57] ABSTRACT

A seating unit, such as a sofa, chair or love seat with a movable seat section includes a main frame arranged for support of a back rest in fixed relation thereto and a seat frame for supporting a seat. Support tracks slidably support the seat frame from the main frame. The seat frame can be moved from a retracted position to an extended position in relation to the main frame. A locking device secures the seat frame in relation to the main frame in a plurality of positions between the retracted position and the extended position.

14 Claims, 15 Drawing Sheets

SEATING UNIT WITH MOVABLE SEAT

BACKGROUND OF THE INVENTION

This invention pertains to furniture. More particularly, the invention pertains to a seating system, such as a sofa, love seat or chair having a movable seat section.

Convertible seat bed units of various constructions and useable both for seating and sleeping are well known in the art. In many of these, a flexible bed platform is held in a curved condition in a sofa portion of the seat bed unit. Once the seat cushions are removed, the bed platform can be slid out of the sofa portion and is straightened out. Convertible sofa-bed units are also known in which a rigid seat support frame is mounted on a main frame for movement of the seat between a rearward seating position-in which a rear edge of the seat is located under a back rest--and a forward sleeping position, in which the rear edge of the seat is located forwardly of the backrest and is raised to level the bed. A typical patent disclosing such an embodiment is the Quakenbush U.S. Pat. No. 3,816,860 . Another such sofa-bed unit is disclosed in the Fox U.S. Pat. No. 3,005,997.

In the known art as exemplified by these two patents, the angle at which the seat frame is oriented in relation to a horizontal plane parallel to the floor changes as the seat frame is moved from its seating position to its sleeping position. In the seating position, the seat frame is disposed at an acute angle to a horizontal plane. In the sleeping position, the seat frame is disposed in the horizontal plane. The angle of the seat frame changes because it is desirable, when the seat frame is used for sleeping, to have the seat frame be parallel to the floor surface, and hence the horizontal plane, so that a person sleeping on the seat frame of the sofa-bed does not roll off the seat frame or roll into the backrest of the sofa. In contrast, in a normal seated position, it is desirable to position the seat frame at an acute angle to the horizontal so that a seated person does not slide off the sofa. To this end, the seat frame is normally tilted in relation to a horizontal plane by approximately 1° to 3° or so.

One of the problems with conventional couches and seats is that for a person with long legs, the seat portion of the couch or chair is usually not long enough to support all of the thigh of the person so that the backs of the knees are supported by the seat cushions. If the known sofa-bed units disclosed in the Quakenbush '860 patent and the Fox '997 patents were to have their seat frames moved forward, this would accommodate the legs of longer persons. However, the orientation of the seat frames would be changed from an acute angle to the horizontal—which is desirable when sitting—to the horizontal plane. This orientation is uncomfortable for seated persons as they would have a tendency to slide off the seat frame.

Another problem with conventional couches and seats is that the extension of the seat frame in relation to the main frame cannot be controlled so that the seat frame can be locked in relation to the main frame at a number of positions between a fully retracted position and a fully extended position. Rather, in the sofa-bed units disclosed in the Quakenbush '860 patent and the Fox '997 patent, there is only a fully retracted position and a fully extended position. This is understandable since the thrust of both of these patents is to a sofa which converts into a bed rather than a sofa having a slidable seat section.

In addition, the known sofa-bed units do not allow a sliding motion of the seat frame in relation to the main frame when a person is seated on the seat frame. Rather, the person has to get up to move the seat frame. This is understandable because the seat frame is being turned into a bed.

It would be desirable to have the seat frame which, when slid forwardly, maintains an acute angle in relation to the main frame so that a person sitting on the seat frame can have the backs of his knees supported by the seat cushions while at the same time not having a tendency to slide off the seat cushions because of a change in the orientation of the seat frame in relation to the horizontal plane. It would also be desirable to have a seat frame that can be moved while the person remains seated and that can be locked into a number of positions between a fully retracted position and a fully extended position so that the person can regulate the length of the seat portion.

Accordingly, it has been considered desirable to develop a new and improved seating system which can be used on couches, love seats or chairs which would overcome the foregoing difficulties and others, meet the above stated needs and provide better and more advantageous overall results.

BRIEF SUMMARY OF THE INVENTION

In accordance with the present invention, a seating unit is provided with a movable seat section.

More particularly in accordance with this aspect of the invention, the unit comprises a main frame arranged for support of a backrest and a seat frame for supporting a seat. A support track movably supports the seat frame on the main frame. The support track comprises a first member fixed to the main frame and a second member fixed to the seat frame. The first member cooperates with the second member for moving the seat frame from a retracted position to an extended position in relation to the main frame. A locking means is provided for securing the seat frame in relation to the main frame in a plurality of positions between the retracted position and the extended position.

If desired, the locking means can comprise a plate mounted on the seat frame, the plate comprising a plurality of spaced slots, an arm pivotally mounted on the main frame and adapted to engage one of the slots and a biasing means for urging the arm to one end position in relation to the main frame in order to engage one of the slots. The locking means can further comprise a means for moving the arm away from the plate to allow movement of the rail in relation to the arm. The means for moving can comprise a cable having a first end secured to the arm and a second end and an actuation means to which the cable second end is secured.

If desired, the seat frame can comprise first and second side rails which are spaced from each other, a back rail to a respective end of which a respective first end of the first and second side rails are secured and a front rail spaced from the back rail to which a respective second end of the first and second side rails are secured. An apron can have a first end secured to the main frame and a second end secured to the seat frame back rail.

If desired, a motor can be provided for moving the seat frame in relation to the main frame, the motor being secured to one of the seat frame and the main frame and a means can be operated by the motor for coacting with the other of the seat frame and the main frame. If desired, the means operated by the motor can comprise a screw housing. On the other hand, the means operated by the motor can comprise a sprocket wheel and the seat frame can further comprise an element which cooperates with the sprocket wheel.

The first member of the support track can comprise a first slide member mounted on the main frame along one side of the seat frame and the second member of the support track can comprise a slide member mounted on the seat frame and located parallel to and adjacent to the first slide member so that the second slide member can cooperate with the first slide member. On the other hand, the first member of the support track can comprise a first glide track mounted on the main frame and the second member of the support track can comprise a glide track mounted on the seat frame and located adjacent the first glide track so that the second glide track can cooperate with the first glide track. Preferably, the seat frame is oriented at an acute angle in relation to a horizontal plane in all locations of the seat frame.

One advantage of the present invention is the provision of a new and improved seating unit, such as a sofa, love seat or chair having a movable seat section.

Another advantage of the present invention is the provision of a seating unit having a seat frame which slides in relation to a main frame from a rearward position to a forward position thereby enabling a person seated on the seat frame to lengthen an effective length of the seat so as to allow the backs of the knees of that person to be supported by the forward edge of the seat even if the person's legs would otherwise be too long for this purpose.

Still another advantage of the present invention is the provision of a seating unit having a seat frame which is slidably mounted in relation to a main frame such that the seat frame is oriented at an acute angle in relation to a horizontal plane at all positions of the seat frame.

A further advantage of the present invention is the provision of a seating unit having a seat frame which is movable in relation to a main frame, even when a person is sitting on the seat frame, and a locking means for securing the seat frame in relation to the main frame in a plurality of positions between a retracted position and an extended position.

A yet further advantage of the present invention is the provision of a seating unit having a rigid seat frame which is slidably supported from a main frame on support tracks such as slides or glides.

Still other benefits and advantages of the invention will become apparent to those of average skill in the art upon a reading and understanding of the following detailed specification.

BRIEF DESCRIPTION OF THE DRAWINGS

The invention may take physical form in certain parts and arrangements of parts, several preferred embodiments of which will be described in detail in this specification and illustrated in the accompanying drawings, which form a part hereof and wherein.

DETAILED DESCRIPTION OF THE PREFERRED EMBODIMENTS

Figure 1:
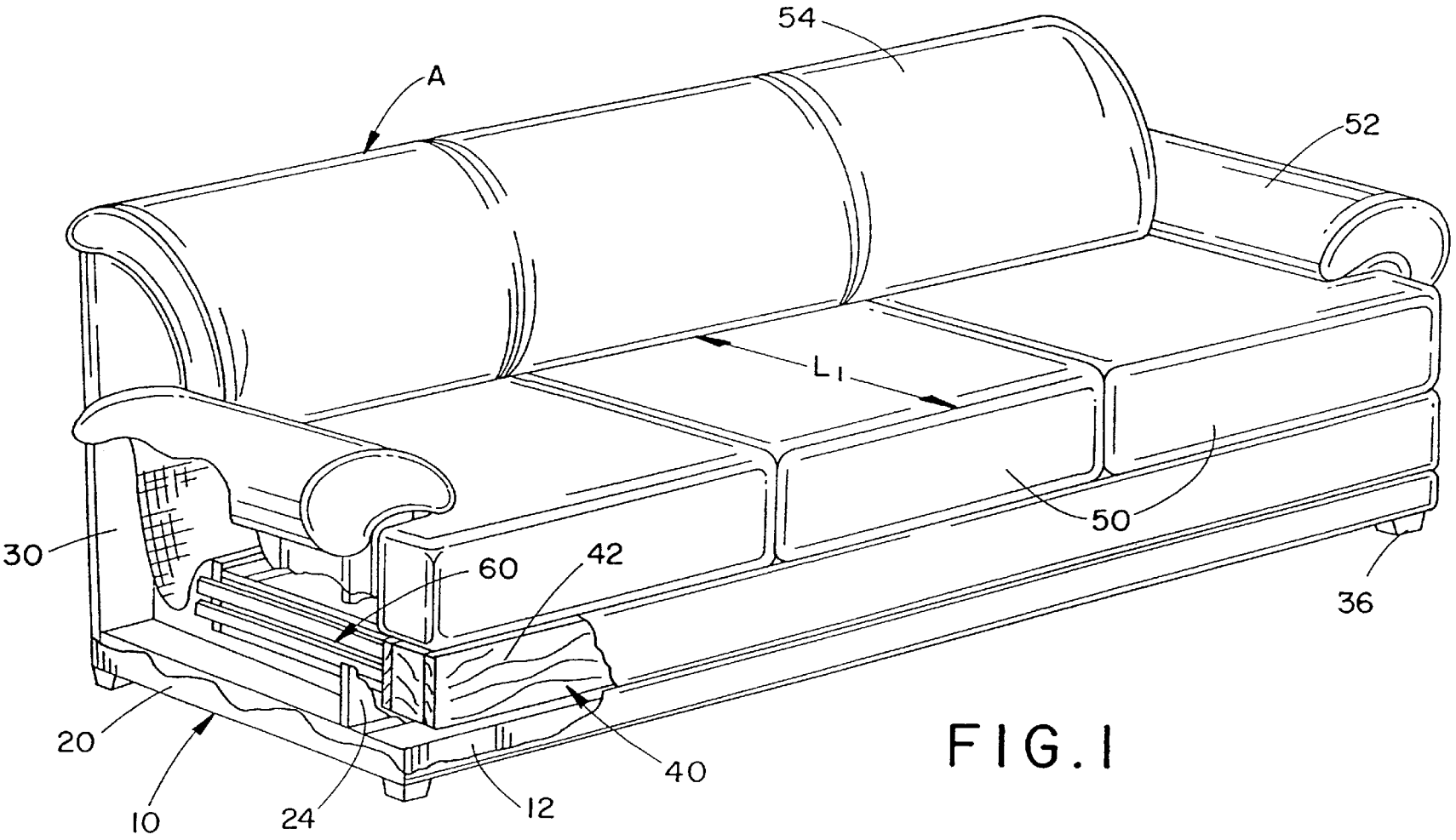
FIG. 1 is a perspective view, partially broken away, of a sofa according to the present invention in a retracted position.
Figure 5:
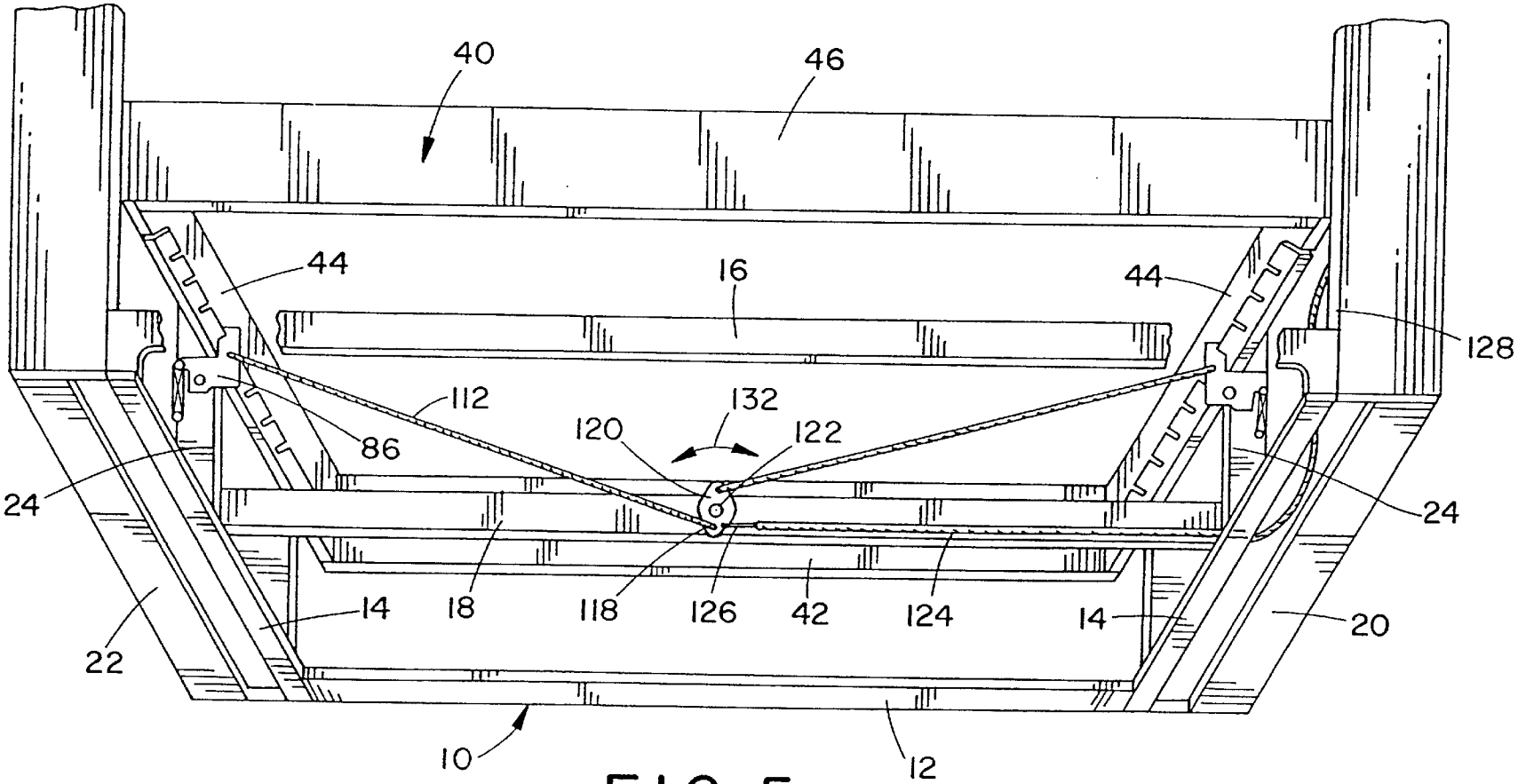
FIG. 5 is a perspective view from the bottom rear of the sofa of FIG. 1 with many portions of the sofa broken away for clarity.

Referring now to the drawings, wherein the showings are for purposes of illustrating several preferred embodiments of the invention only and not for purposes of limiting same, FIG. 1 shows a sofa A according to the present invention. The sofa includes a main frame 10 for supporting a backrest section and a seat section, as well as the arm sections of the sofa. With reference now also to FIG. 5, the main frame 10 comprises a front rail 12, a pair of spaced side rails 14 and a rear rail 16. A central rail 18 extends between the side rails 14 and is positioned between the front and rear rails to stiffen the main frame 10. Secured to a respective side rail 14 are left and right arm support truss members 20 and 22. A vertical brace 24 extends upwardly from each of the side rails 14 such that the central rail 18 is secured thereto. As best illustrated in FIG. 6, a horizontal brace member 26 is secured to each of the left and right arm support trusses 20 and 22.

Figure 3:
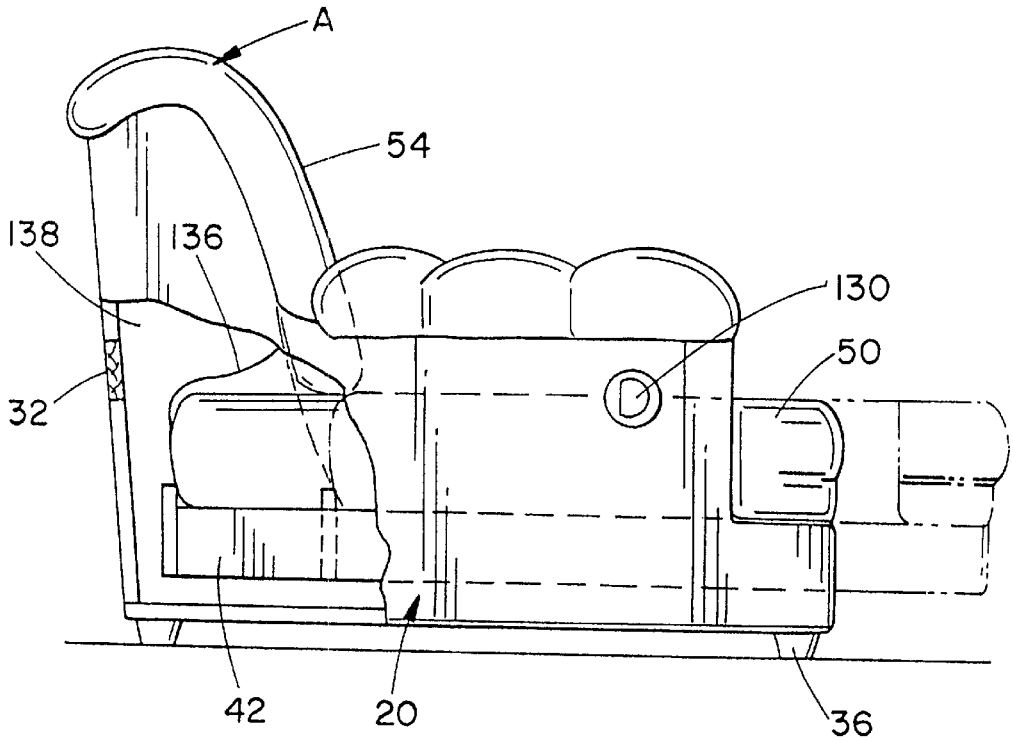
FIG. 3 is a side elevational view, partially broken away, of the sofa of FIG. 1.

With reference now again to FIG. 1, the main frame 10 also has a backrest truss 30 which extends vertically from the rear rail 16. As best shown in FIG. 3, a horizontal brace 32 is fastened between opposing ends of the backrest truss 30 to stiffen same. Normally, a support foot 36 is provided at each corner of the main frame 10 to elevate the sofa A from the subjacent floor surface.

Figure 2:
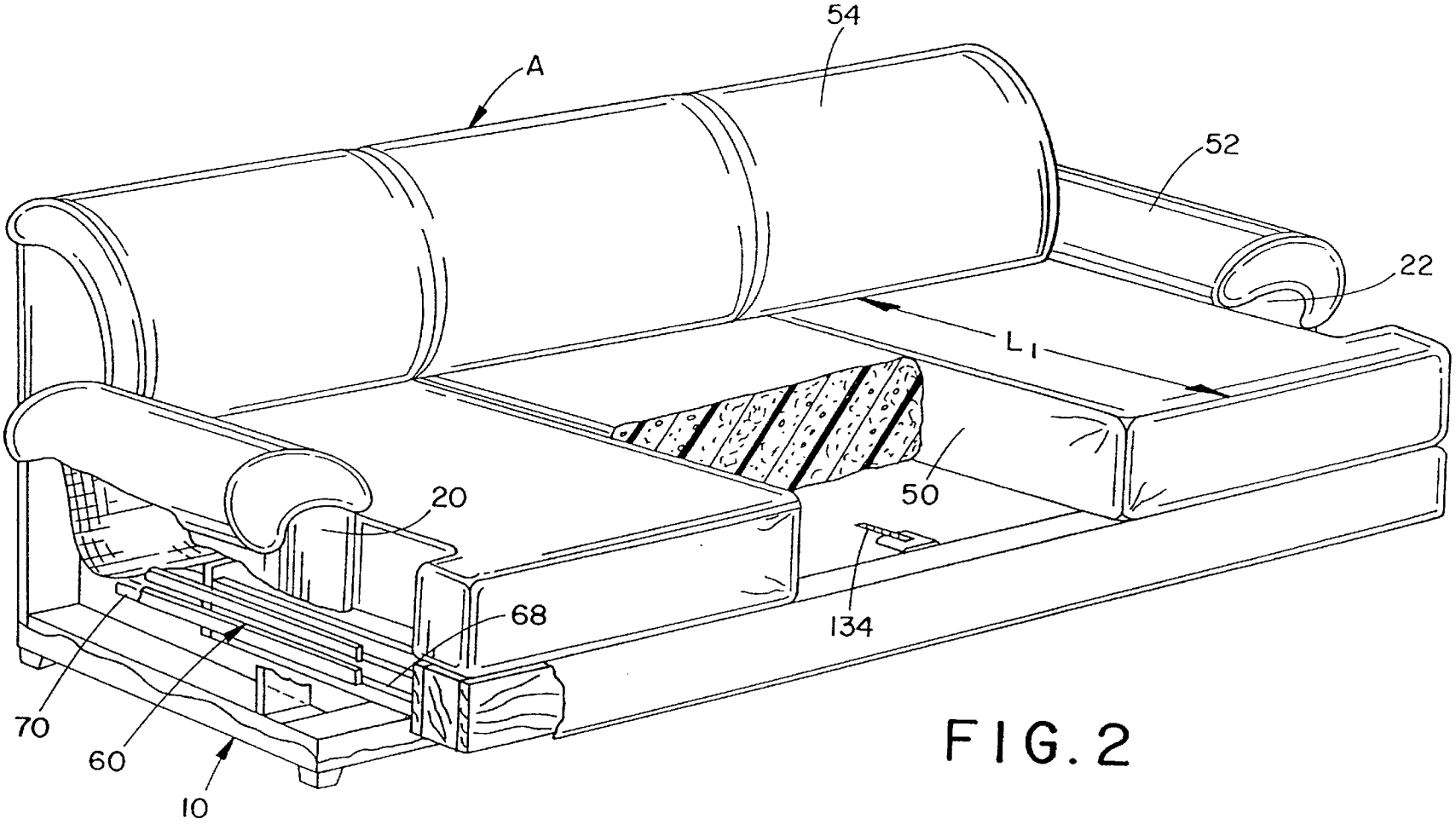
FIG. 2 is a perspective view, partially broken away, of the sofa of FIG. 1 in an extended position.

Slidably mounted on the main frame 10 is a seat frame 40. With reference now again to FIG. 5, the seat frame comprises a front rail 42, a pair of side rails 44 and a rear rail 46 which are all secured together to form a box frame. Supported on the seat frame are a plurality of cushions 50 as illustrated in FIG. 2. It can be seen from FIGS. 1 and 2 that the two end cushions have arms which extend sideways so that they protrude in front of the arm supports 20 and 22. To this end, the seat frame 40 also has lateral extensions to support these portions of the cushions. Arm padding 52 is provided atop the left and right arm supports 20 and 22 and an upholstered back 54 is secured to the backrest section 30 of the main frame 10.

Figure 6:
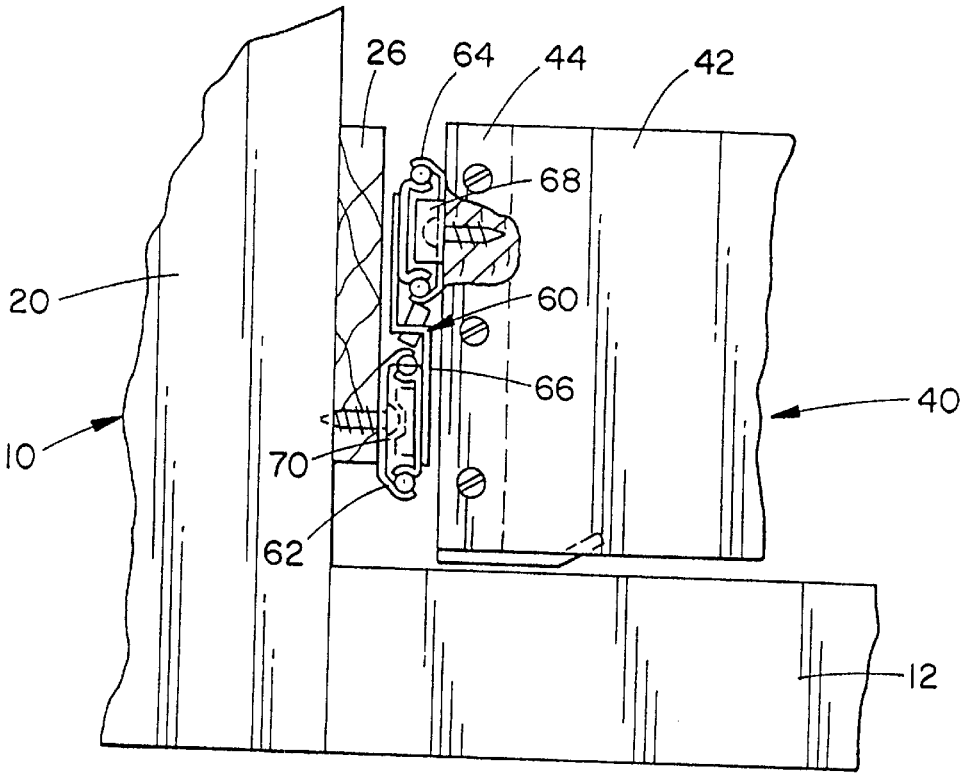
FIG. 6 is an enlarged front elevational view of a portion of the sofa of FIG. 1 with certain parts thereof removed for clarity.

With reference now to FIG. 6, the seat frame 40 is slidably supported on the main frame 10 by a support track 60. The track can comprise a first track member 62 fastened to the horizontal brace 26, which is secured to the right arm section 20 of the main frame 10, and a second track member 64 fastened to the side rail 44 of the seat frame 40. A somewhat S-shaped connecting element 66 joins a pair of slide elements 68 and 70 which are mounted in respective ones of the track members 62 and 64. As best illustrated in FIG. 2, the slide elements of the first and second track members enable the seat frame 40 to slide from a retracted position to an extended position in relation to the main frame 10. The support tracks can be conventional drawer slides of the type manufactured by Knape & Vogt of Grand Rapids, Mich. under model No. 8500P. Of course, a variety of other known slides, which can have single tracks, triple tracks or any other desired number of tracks, could also be used.

Figure 4:
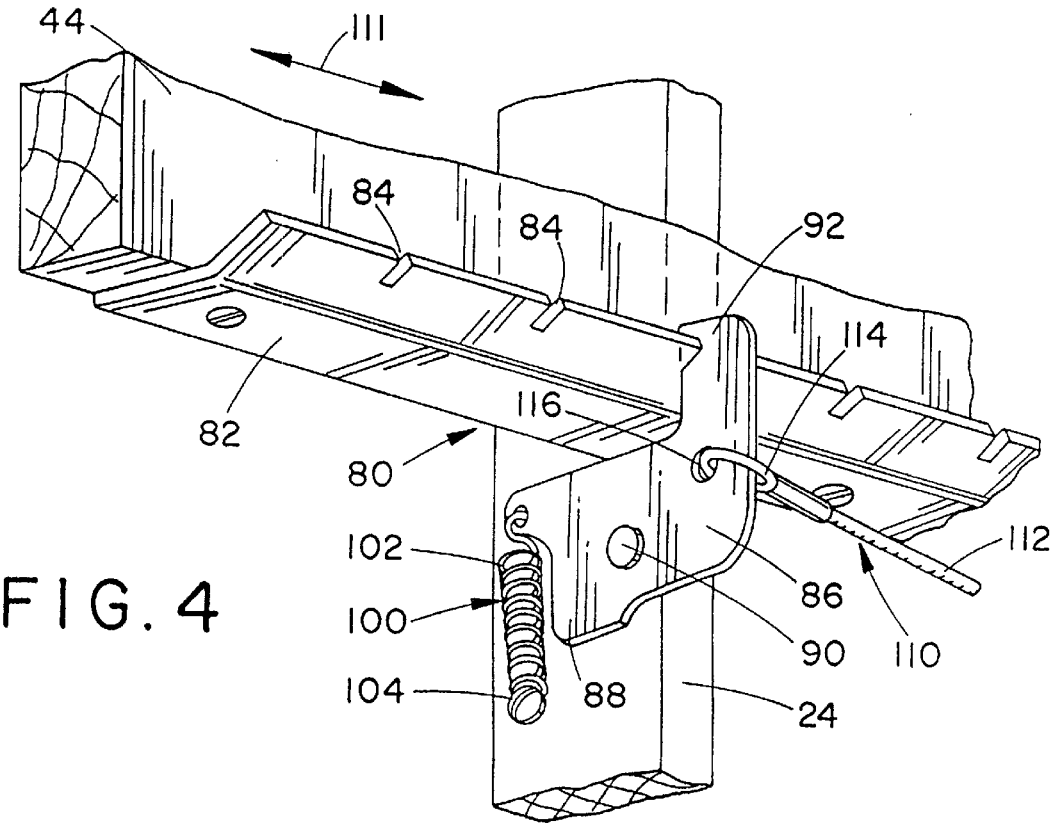
FIG. 4 is a greatly enlarged perspective view of a portion of the sofa of FIG. 1.

With reference now to FIG. 4, a locking means is provided for securing the seat frame 40 in relation to the main frame 10 in a plurality of positions between the retracted position illustrated in FIG. 1 and the extended position illustrated in FIG. 2. The locking means can comprise a plate 82 which is conventionally fastened—by screws or the like—to one of the side rails 44 of the seat frame 40. The plate has a plurality of horizontally spaced slots 84 therein. For example, the slots can be spaced from each other at 1 inch intervals, or at other desired intervals. Cooperating with the plate 82 is an arm 86. The arm has a first section 88 which is secured via a pivot fastener 90 to the vertical brace 24 of one of the right and left arm supports 20, 22. The locking plate 82 also has a second section 92 which is adapted to fit into any of the slots 84.

A biasing means 100 is employed to urge the plate 82 into an end position such that the plate second section 92 extends into one of the slots 84. The biasing means can comprise a spring 102 having a first end secured via a conventional fastener 104 to the vertical brace 24 and a second end secured in an aperture 106 of the plate first section 88. A control means 110 acts on the plate to rotate it around pivot 90 in opposition to the biasing means 100 so as to remove the plate second section 92 from the slots and thereby enable a horizontal movement of the seat frame 40 in relation to the main frame 10 as illustrated by arrow 111. The control means can comprise a cable 112 having a first end 114 secured in an aperture 116 defined in the plate 82. As illustrated in FIG. 5, the cable 112 has a second end 118 which is secured in a suitable aperture in a pivot plate 120. The pivot plate is secured via a fastener 122 to the central rail 18 of the main frame. It is evident from FIG. 5 that a pair of locking means 80 and its attendant biasing means and control means are provided so that each side rail 42 of the seat frame 40 has a respective plate 82 fastened thereto. Similarly, each of the vertical braces 24 has a respective arm 86 pivotally fastened thereto.

A control cable 124 is used to rotate the pivot plate 120. The cable has a first end 126 fastened to the pivot plate 120 and a second end 128 which is secured to a control knob 130 (see FIG. 3). Pulling the knob will pull the control cable 124 thereby pivoting the pivot plate 120 as illustrated by arrow 132. The rotating motion of the pivot plate 120 will cause the respective cables 112 to pull on the respective arms 86 in opposition to the respective biasing means 100 thereby removing the arm second sections 92 from the respective slots 84. This will enable the seat frame 40 to be then slid on the support track 60 in relation to the main frame 10. With the structure of the present invention, such sliding can take place even if a person is seated on the seat frame. Alternatively, a pull strap 134, as illustrated in FIG. 2, can be employed to pull on the control cable 124 and rotate the pivot plate 120.

As mentioned, the slots 84 in the plate 82 could be spaced apart at one inch intervals, one half inch intervals, two inch intervals or the like, if desired. There could be, for example, thirteen such slots on the plate 82. This enables a sequential movement of the seat frame 40 in relation to the main frame 10 by the chosen number of intervals. In sum, the seat can be slid forward in relation to the base of the sofa by a predetermined amount to suit the comfort of the occupant. In a prototype of a couch built according to the present invention, the length of the seat portion can be increased from 24.75 inches to 33.75 inches by the sequential movement of the seat frame forwardly from its retracted position to its extended position. Even in its extended position, the seat frame 40 is fully supported by the main frame 10 due to support track 60 which has elements fastened to each of the main frame and the seat frame.

It should be evident that with this arrangement, the cushions 50 must be deeper than they are on a conventional sofa or chair so as to accommodate the forward sliding motion of the seat frame in relation to the main frame, as best shown in FIG. 3. The cushions 50 in a retracted position of the seat frame, have a rear end extending beneath the upholstered back 54 of the sofa A. In order to insure that no articles fall between the upholstered back 54 and the rear edges of the seat cushions 50 when the seat frame is slid to its forwardmost position—as illustrated in dashed outline in FIG. 3—there is provided an apron 136 having one edge secured to the upholstered back 54 and another edge secured to the seat frame rear rail 46. In the retracted position of the seating unit, the apron 136 is hidden in a cavity 138 defined below the upholstered back 54 of the sofa A and the rear ends of the cushions 50 protrude into the cavity. In conventional couches and sofas, the cavity can have a depth of between five and thirteen inches and this space is unused. The aprom 136 also keeps the cushions 50 from being pushed back into the cavity 138.

Figure 7:
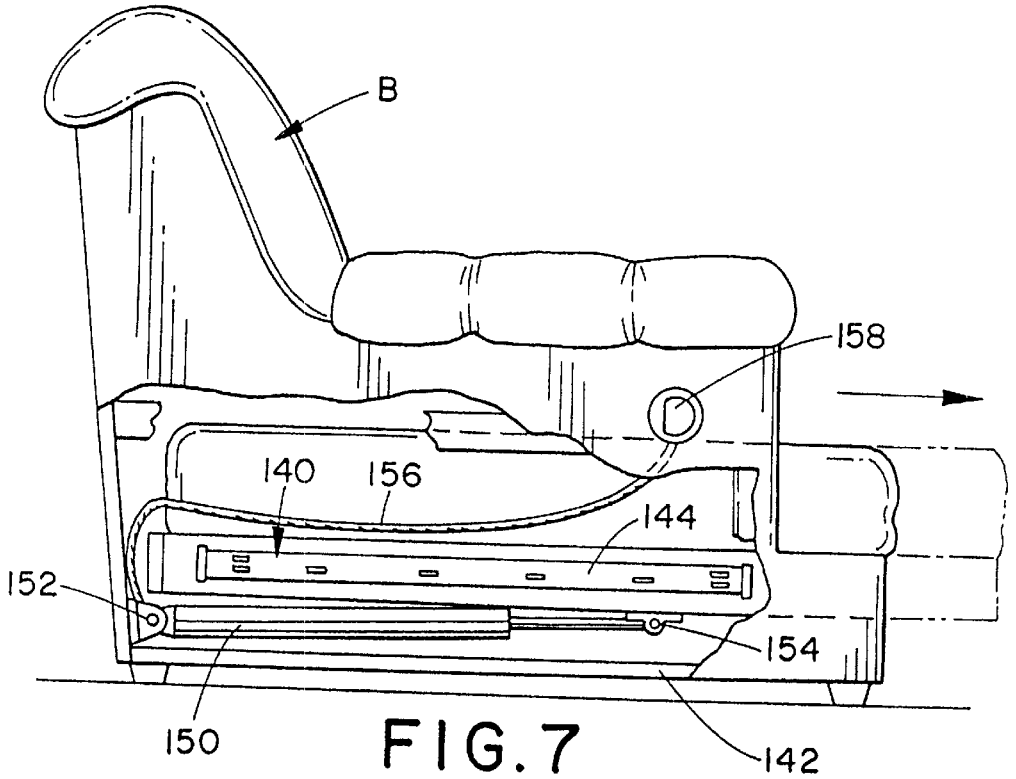
FIG. 7 is a side elevational view, partially broken away, of a chair according to a second preferred embodiment of the present invention.

With reference now to FIG. 7, there is shown a different means for extending a seat frame portion 140 in relation to a main frame portion 142 of a chair B. In this embodiment, while the same type of support track 144 is employed as in the embodiment of FIGS. 1–6, a means is provided for urging the seat frame to move in relation to the main frame. The means comprises a cylinder 150 having a cylinder end 152 pivotally secured to the main frame 142 and having a piston rod end 154 pivotally secured to the seat frame 140. A control cable 156 is actuated by a control knob 158 to actuate the cylinder and allow the piston and rod thereof to move in relation to the cylinder thereby allowing the seat frame 140 to slide in relation to the main frame 142. The chair B can employ the same type of locking mechanism as illustrated above in connection with FIG. 4.

Alternately, the cylinder 150 can be employed as a locking means. If the seat frame 140 is extended from the main frame 142 manually, the cylinder 150 can be used only as a locking means for selectively securing the seat frame in relation to the main frame at one of a plurality of positions. With the cylinder and piston rod arrangement, an infinite number of positions can be provided between a retracted position, as illustrated in solid outline in FIG. 7 and an extended position illustrated in dashed outline.

Figure 8:
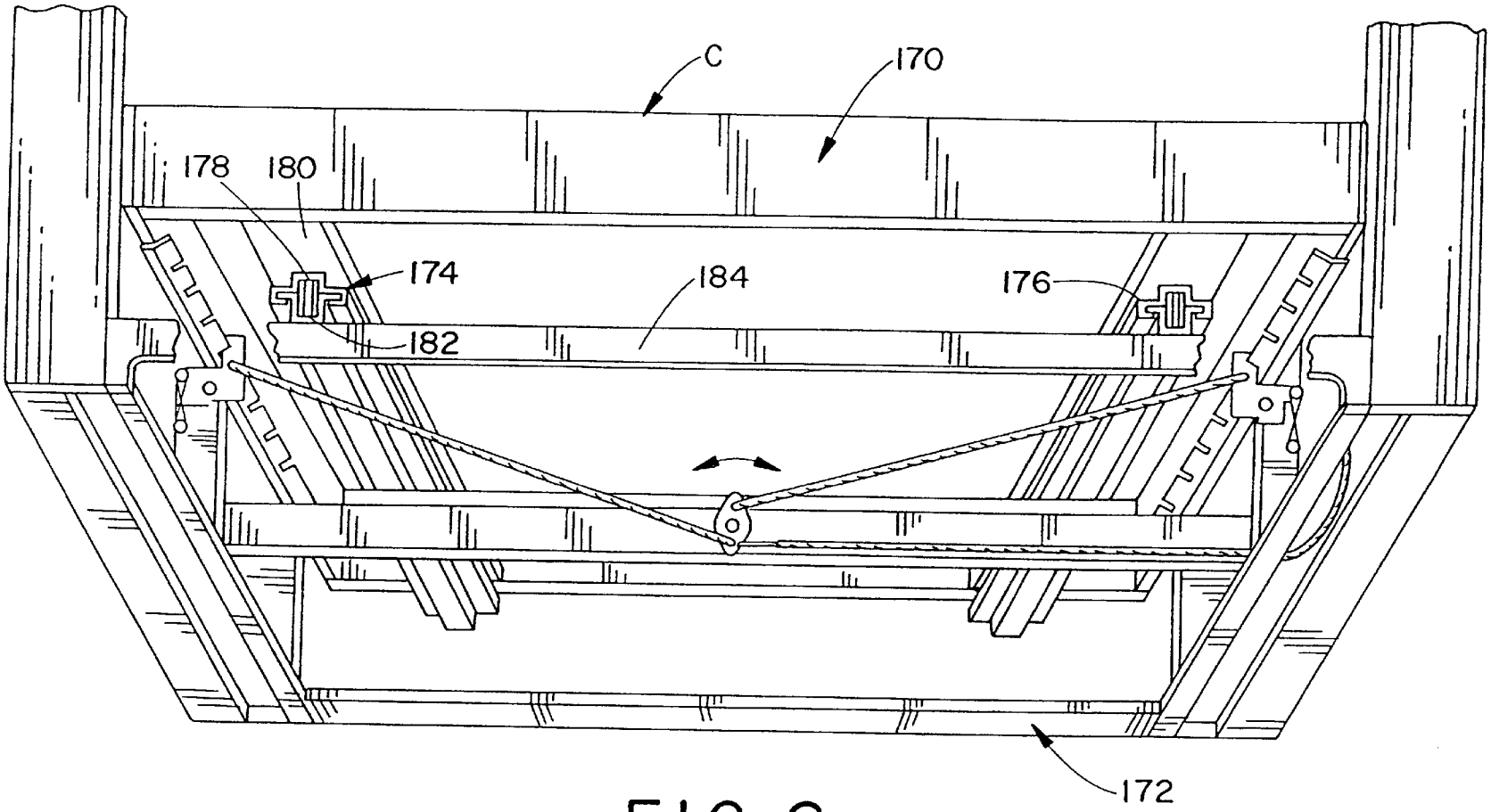
FIG. 8 is a perspective view of a sofa according to a third preferred embodiment of the present invention.

With reference now to FIG. 8, there is shown a sofa C having a seat frame 170 and a main frame 172. In this embodiment, rather than employing the support track illustrated in FIGS. 1–6, there are provided a pair of spaced glide tracks 174 and 176 located beneath the seat frame. The glide tracks are conventional and are identical to each other. Therefore, only one will be discussed in detail herein. The glide track 174 has a first element 178 fastened to a support member 180, which in turn is fastened to the seat frame 170 and extends parallel to the side rails thereof, and a second element 182 which is fastened to a cross brace 184 of the main frame 172. The glide tracks enable a smoother gliding effect on pulling out the seat frame.

Figure 9:
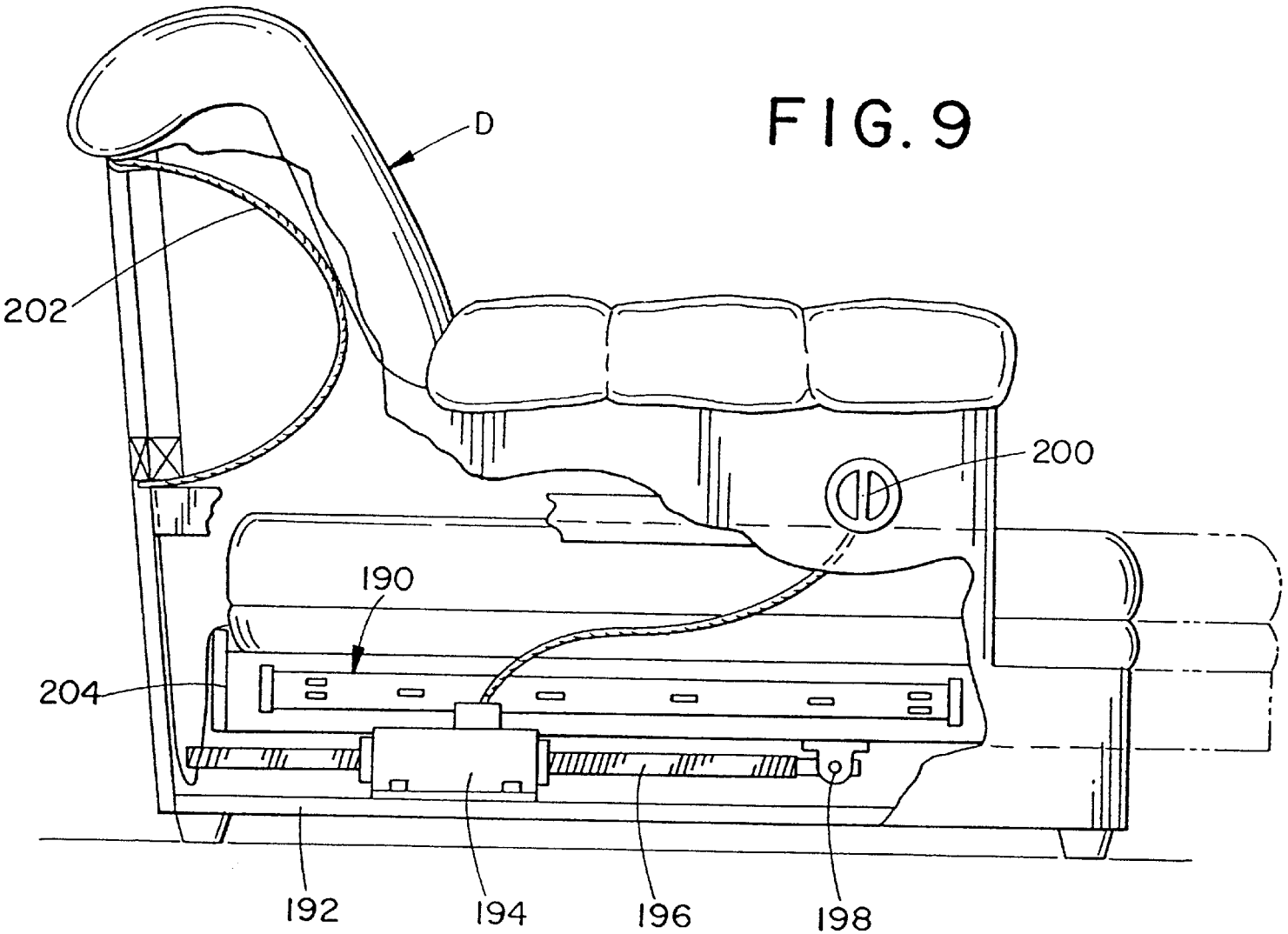
FIG. 9 is a side elevational view of a love seat according to a fourth preferred embodiment of the present invention.

With reference now to FIG. 9, there is shown a love seat D having a seat frame 190 that is slidably mounted on a main frame 192. A means for moving the seat frame 190 in relation to the frame 192 comprises a motor 194 which selectively operates a screw shaft 196 such as a conventional acme screw thread shaft having a first end 198 which is pivotally secured to the seat frame. A conventional handle control 200 enables a rotation of the motor 194 either in a forward direction, so as to extend the seat frame out of the main frame, or rearwardly so as to retract the seat frame back into the main frame. The motor 194 can be located at a desired location along the depth of the love seat. Obviously with this embodiment, electrical power is necessary to the motor 194. While one such motor is illustrated in FIG. 9, it should be appreciated that two motors can be provided, one on each end of the love seat D if so desired.

FIG. 9 further illustrates a flat "S" spring 202 which is suitably secured to the main frame 192. A plurality of such S springs are used to urge the backrest outwardly and provide support for the back of the seat's occupant.

Figure 10C:
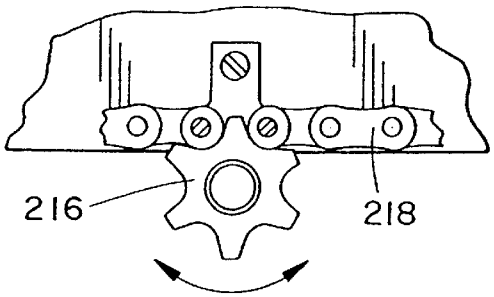
FIG. 10C is a side elevational view of a portion of the sofa taken along lines 10C—10C.
Figure 10B:
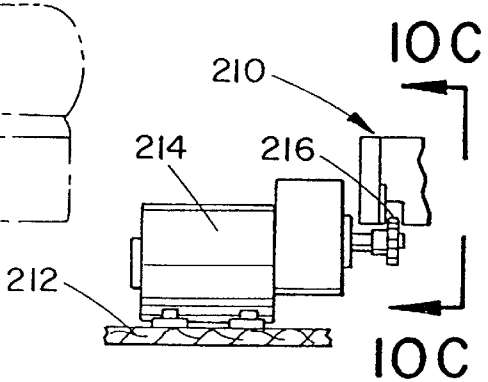
FIG. 10B is a front elevational view of a portion of the sofa of FIG. 10A.
Figure 10A:
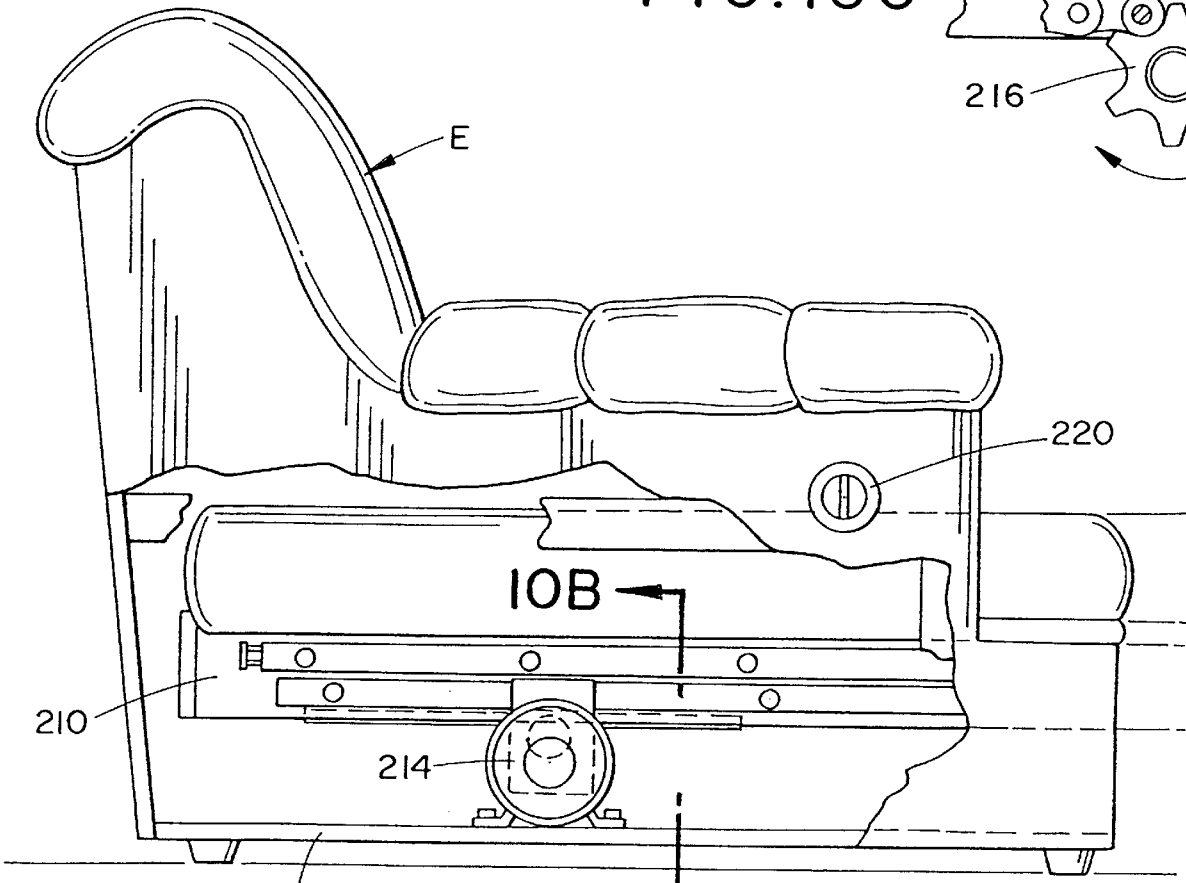
FIG. 10A is a side elevational view, partially broken away, of a sofa according to a fifth preferred embodiment of the present invention.

With reference now to FIG. 10A, another sofa E is there illustrated having a seat frame 210 and a main frame 212. The seat frame is slidably mounted on the main frame via a rail assembly as has been previously described. The seat frame is moved in relation to the main frame via a pair of electric motors 214 (see FIG. 11). Each motor includes a sprocket gear 216 as illustrated in FIG. 10B. The sprocket gear cooperates with a respective rigid chainlike element 218 which is fastened to the seat frame 210 as shown in FIG. 10C. For control purposes, a control knob 220 is mounted on one of the arms of the sofa E. In this embodiment as with the embodiment of FIG. 9, electrical power is necessary to operate the motors.

Figure 11:
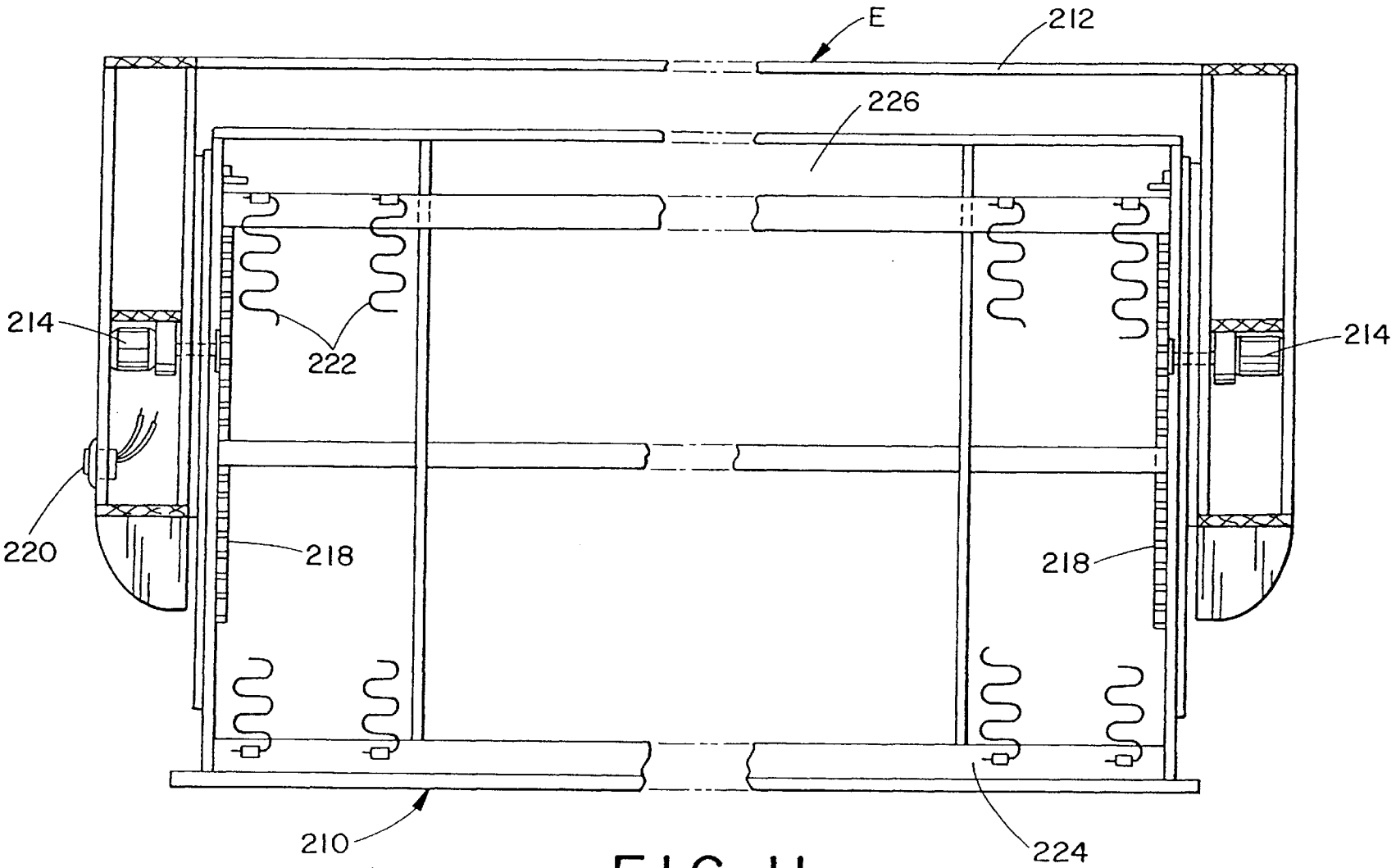
FIG. 11 is a bottom plan view of the sofa of FIG. 10A, partially broken away.

As illustrated in FIG. 11, supporting the cushions on the seat frame 210 are a plurality of spaced flat S springs 222. Each of these is secured to a front support member 224 and a rear support member 226 fastened to the seat frame 210. The support members are preferably boards that are secured by conventional means to the other elements of the seat frame 210. Such springs and boards can be used to support the cushions in the other embodiments illustrated previously.

Figure 12A:
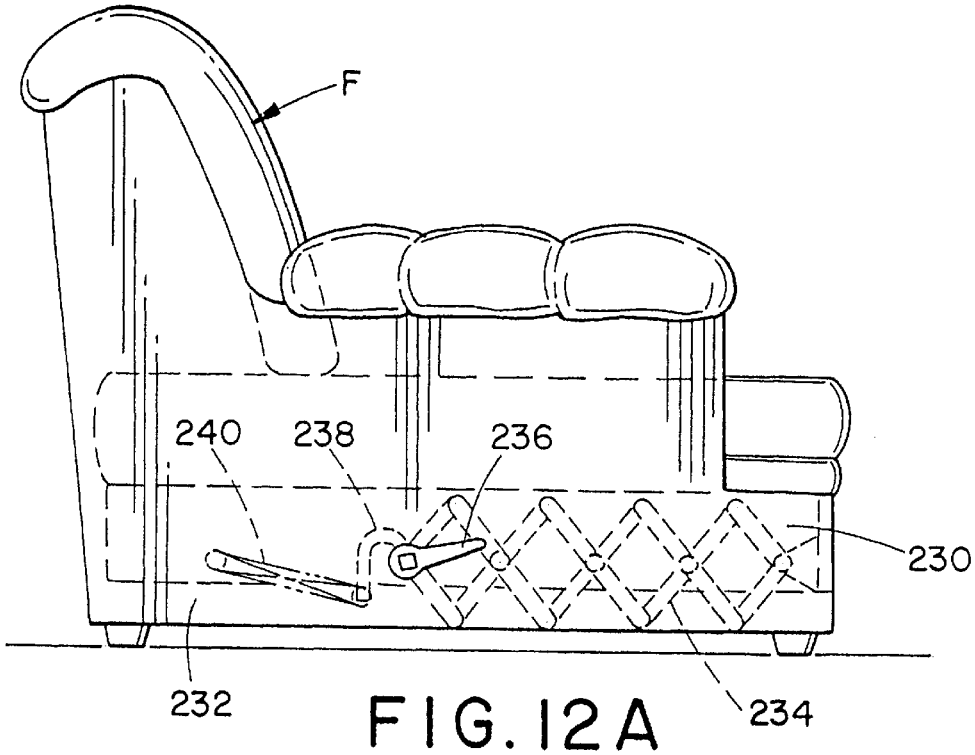
FIG. 12A is a side elevational view of a chair according to a sixth preferred embodiment of the present invention in a retracted position.
Figure 12B:
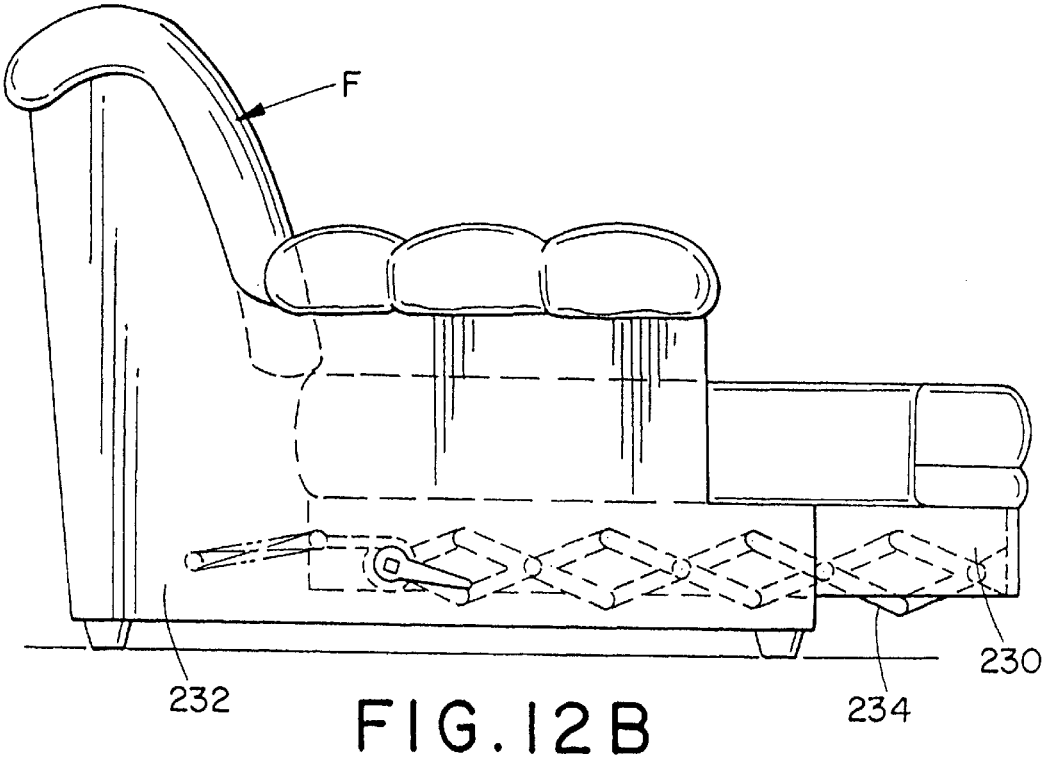
FIG. 12B is a side elevational view of the chair of FIG. 12A in an extended position.

With reference now to FIG. 12A, a chair F includes a seat frame 230 which is slidably mounted in relation to a main frame 232. A control means for actuating the seat frame in relation to the main frame comprises a scissor mechanism 234 which is actuated by a handle 236. The handle is connected to an A-hook 238 which is biased by a spring 240. This mechanism is conventional and enables a movement of the seat frame 230 from the retracted position illustrated in FIG. 12A to the extended position illustrated in FIG. 12B.

Figure 13:
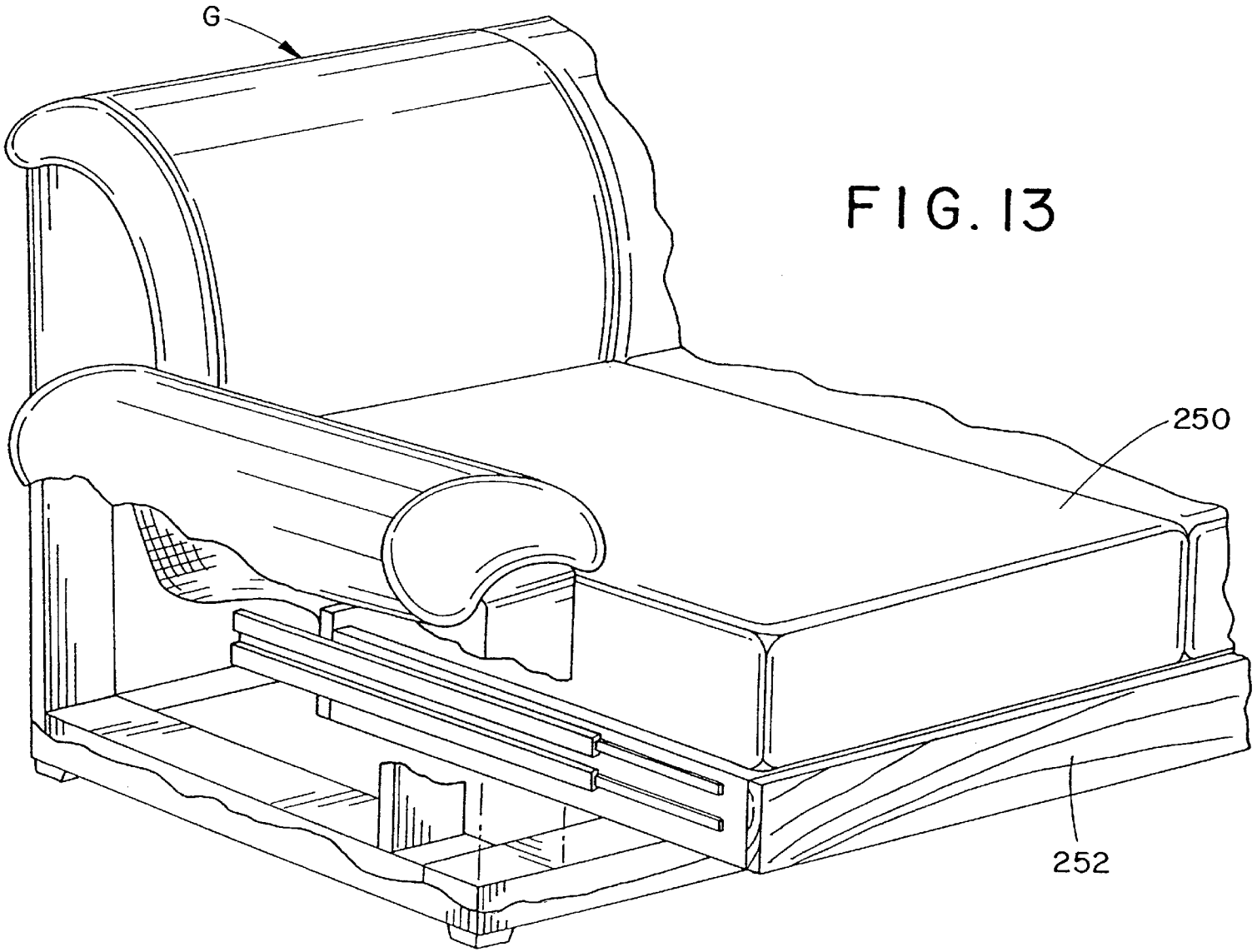
FIG. 13 is a perspective view, partially broken away, of a couch according to a seventh preferred embodiment of the present invention.

FIG. 13 illustrates a couch in which a plurality of cushions 250 are supported on a seat frame 252. Unlike the embodiment illustrated in FIGS. 1 and 2, the cushions 250 are all substantially rectangular and do not have the sidewardly extending protrusions illustrated in FIGS. 1 and 2. Therefore, the seat frame 252 similarly does not have a sidewardly extending section on each end.

Figure 14:
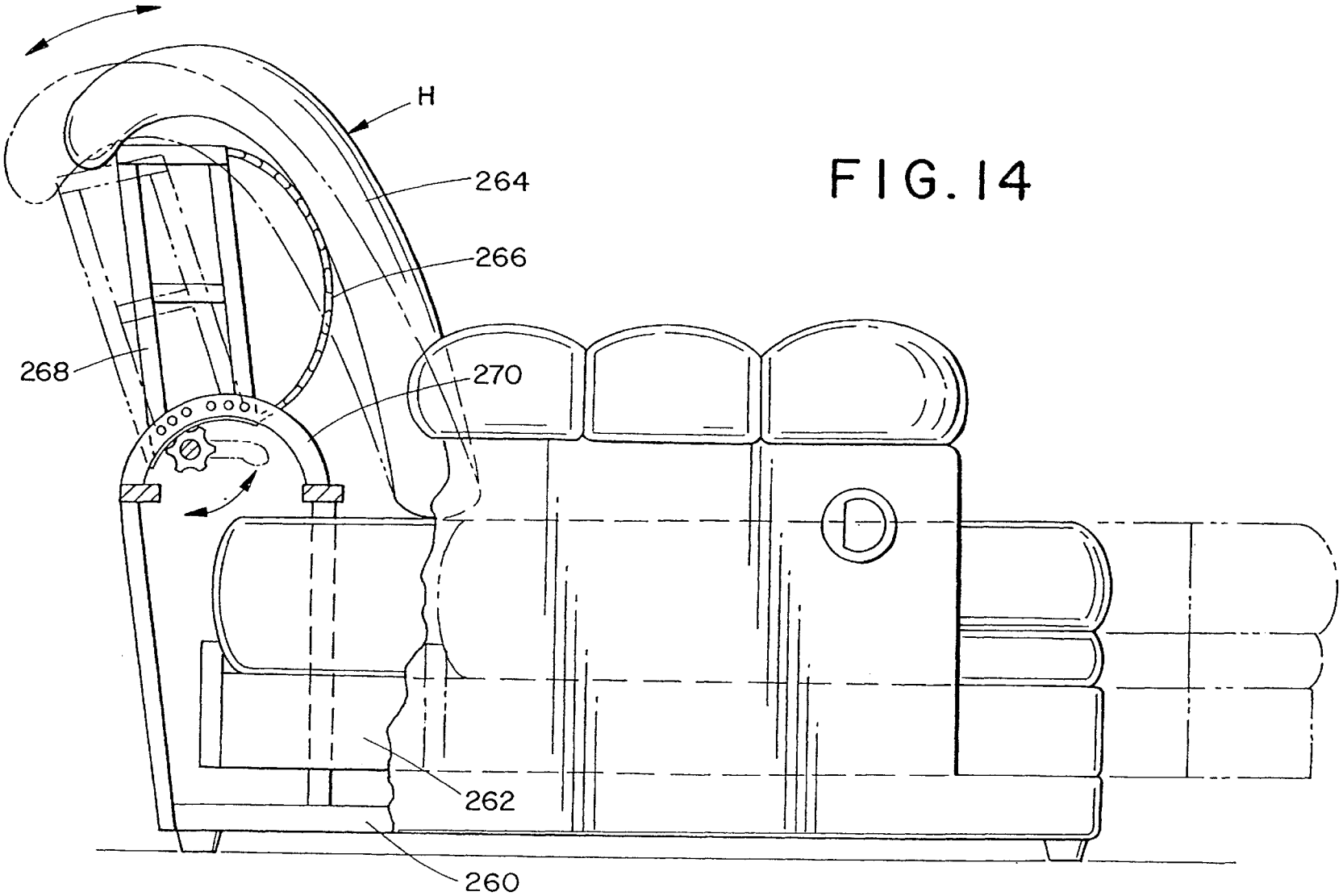
FIG. 14 is a side elevational view, partially in cross-section, of a couch according to an eighth preferred embodiment of the present invention.
Figure 15:
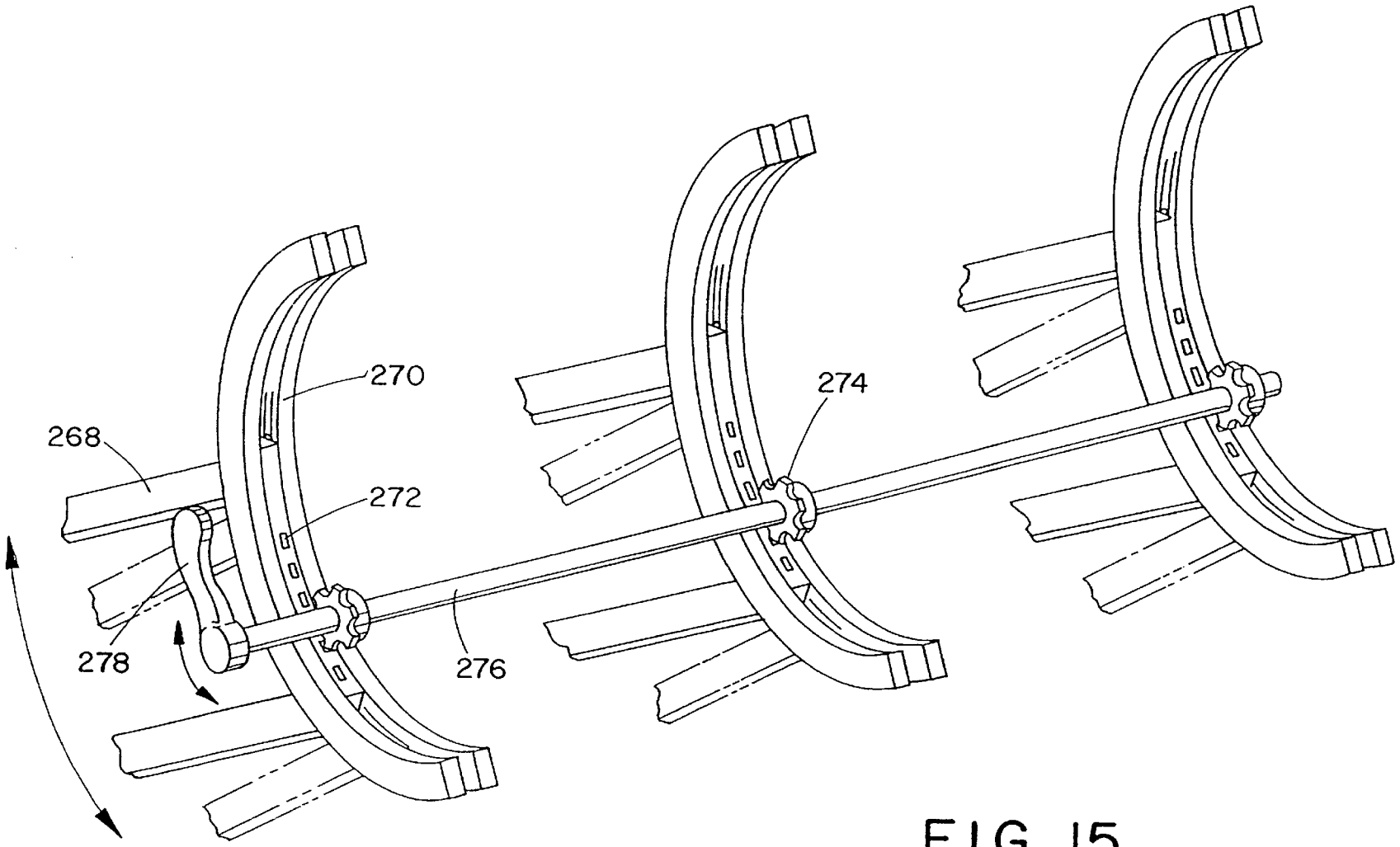
FIG. 15 is a bottom plan view of a backrest reclining mechanism for the couch of FIG. 14.

While all of the foregoing embodiments illustrated a design in which a backrest portion of the couch or seat was fixed, FIG. 14 illustrates an embodiment in which both the backrest and the seat portion of a couch H can move. The couch H comprises a main frame 260 on which a seat frame 262 is slidably supported. The main frame includes a backrest section 264. A set of flat S springs 266 resiliently supports the backrest 264. The springs 266 are mounted on a set of support braces 268. The support braces are, in turn, each fastened to a track 270. As is evident from FIG. 15, a plurality of such tracks are provided with each track being substantially U-shaped. Each track includes a central area having a number of longitudinally spaced slots 272 which are meant to accommodate gear teeth of respective sprockets 274. The sprockets are mounted on a rod 276. One end of the rod has fastened thereon a handle 278 which protrudes out of the backrest portion 264 of the couch so as to be manually engageable. With this embodiment, not only can the seat frame 262 be moved, as illustrated in dashed outline in FIG. 14, but the upper end of the backrest can also be lowered somewhat as similarly illustrated in dashed outline in FIG. 14. Therefore, this embodiment illustrates a movable back support section for a couch which also has a movable seat section.

Figure 16:
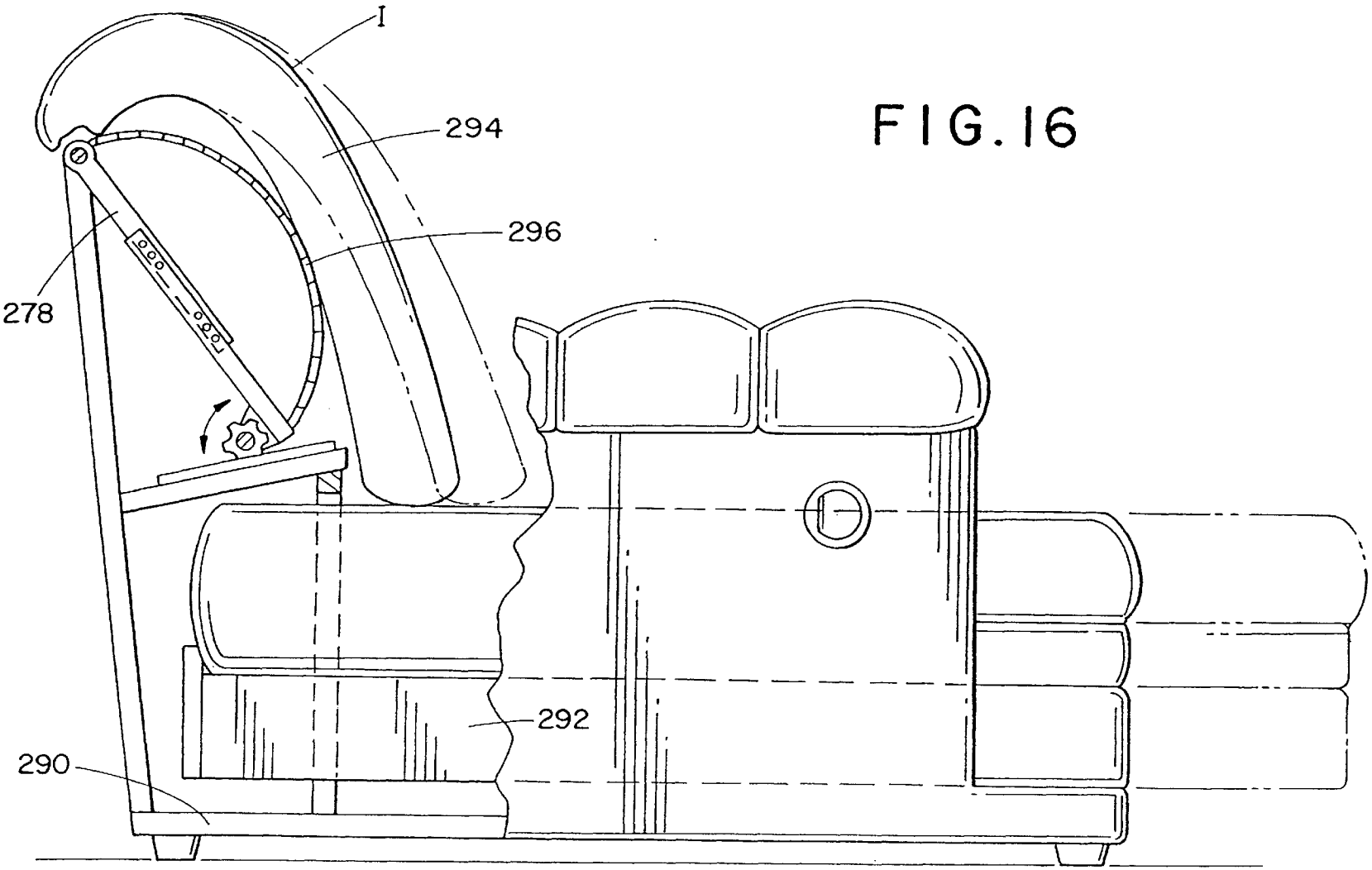
FIG. 16 is a side elevational view, partially broken away, of a couch according to a ninth preferred embodiment of the present invention; and, FIG. 17 is a perspective view from the rear of a backrest reclining mechanism for the couch of FIG. 16.
Figure 17:
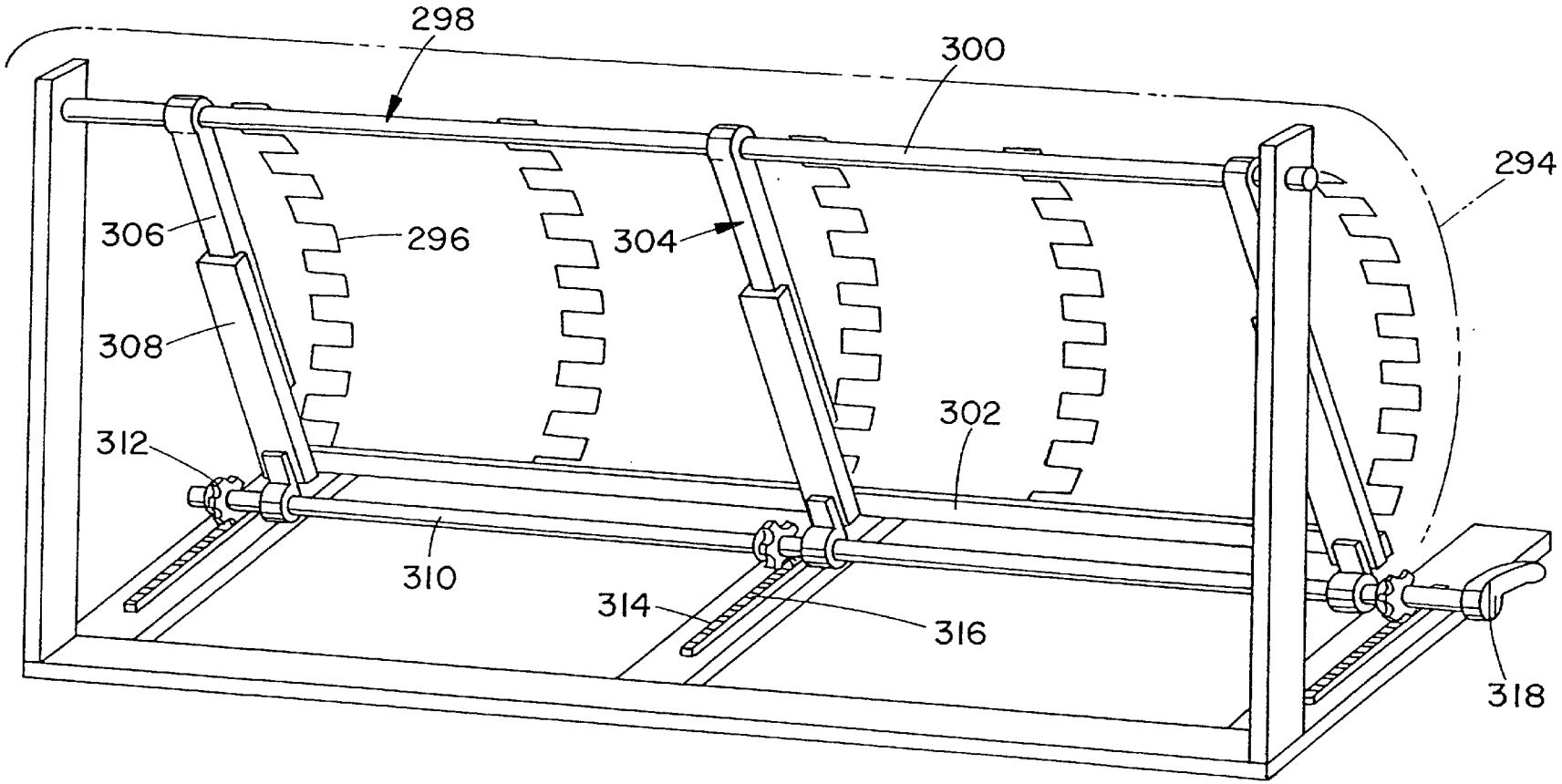

With reference now to FIG. 16, a couch I is there illustrated which has a movable seat and a movable backrest. In this embodiment, a main frame 290 has slidably mounted thereon a seat frame 292. The main frame comprises a backrest section 294 which is resiliently biased by a plurality of spaced flat S springs 296, as can be best seen from FIG. 17. The S springs are mounted on a support frame 298. The support frame comprises an upper rod 300 for holding a first end of each spring 296 and a support bar 302 for holding a second end of each spring. The rod 300 and support bar 302 are joined together by a plurality of spaced brace members 304. These each comprise a first telescopic element 306 and a second telescopic element 308. The set of second elements 308 are secured to a rod 310. Mounted on the rod are a plurality of sprockets 312. The sprockets each travel on a respective track 314 which includes a plurality of longitudinally spaced openings 316 for accommodating the teeth of the sprockets. The rod 310 is actuated by a handle 318 which is mounted on one end thereof so as to extend away from the backrest. With this embodiment of the invention, the bottom end of the backrest support can move inwardly and outwardly as is illustrated in dashed outline in FIG. 16.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

I claim:

1. A seating unit with a movable seat section, comprising:

a main frame arranged for support of a backrest;

a stationary backrest affixed to said main frame;

a seat frame for supporting a seat, said seat frame being independently movable with respect to said backrest, said seat frame comprising a first side rail, a second side rail spaced from said first side rail, a back rail to a respective end of which a respective first end of said first and second side rails are secured, and, a front rail, spaced from said back rail, to which a respective second end of said first and second side rails are secured;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame and, locking means for securing said seat frame in relation to said main frame in a plurality of positions between said retracted position and said extended position.

2. A seating unit with a movable seat section comprising:

main frame arranged for support of a backrest;

a seat frame for supporting a seat, said seat frame comprising a first side rail, a second side rail spaced from said first side rail, a back rail to a respective end of which a respective first end of said first and second side rails are secured, and, a front rail, spaced from said back rail, to which a respective second end of said first and second side rails are secured;

a support track for movably supporting said seat frame on said main frame, said support track comprising a first member affixed to said main frame and a second member affixed to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame;

locking means for securing said seat frame in relation to said main frame in a plurality of positions between said retracted position and said extended position; and an apron having a first end secured to said main frame and a second end secured to said seat frame back rail.

3. A seating unit with a movable seat section comprising:

a main frame arranged for support of a backrest;

a seat frame for supporting a seat, said seat frame comprising a first side rail, a second side rail spaced from said first side rail, a back rail to a respective end of which a respective first end of said first and second side rails are secured, and, a front rail, spaced from said back rail, to which a respective second end of said first and second side rails are secured;

a support track for movably supporting said seat frame on said main frame, said support track comprising a first member affixed to said main frame and a second member affixed to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame;

locking means for securing said seat frame in relation to said main frame in a plurality of positions between said retracted position and said extended position;

wherein said first member of said support track comprises a first slide member mounted on said main frame along one side of said seat frame, and wherein said second member of said support track comprises a second slide member mounted on said seat frame and located parallel to and adjacent to said first slide member so that said second slide member can cooperate with said first slide member.

4. A seating unit with a movable seat section comprising:

a main frame arranged for support of a backrest;

a seat frame for supporting a seat, said seat frame comprising a first side rail, a second side rail spaced from said first side rail, a back rail to a respective end of which a respective first end of said first and second side rails are secured, and, a front rail, spaced from said back rail, to which a respective second end of said first and second side rails are secured;

a support track for movably supporting said seat frame on said main frame, said support track comprising a first member affixed to said main frame and a second member affixed to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame;

locking means for securing said seat frame in relation to said main frame in a plurality of positions between said retracted position and said extended position;

wherein said first member of said support track comprises a first glide track mounted on said main frame, and wherein said second member of said support track comprises a second glide track mounted on said seat frame and located adjacent said first glide track so that said second glide track can cooperate with said first glide track.

5. A seating unit with a movable seat section comprising:

a main frame arranged for support of a backrest;

a seat frame for supporting a seat;

a support track for movably supporting said seat frame on said main frame, said support track comprising a first member engaged to said main frame and a second member engaged to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame;

a motor for moving said seat frame in relation to said main frame, said motor being secured to one of said seat frame and said main frame; and, a means operated by said motor for coacting with the other of said seat frame and said main frame, said means operated by said motor comprises a sprocket wheel and said seat frame further comprises an element which cooperates with said sprocket wheel.

6. A seating unit with a movable seat section comprising:

a main frame arranged for support of a backrest;

a seat frame for supporting a seat, said seat frame comprising a first side rail, a second side rail spaced from said first side rail, a back rail to a respective end of which a respective first end of said first and second side rails are secured, and, a front rail, spaced from said back rail, to which a respective second end of said first and second side rails are secured;

a support track for movably supporting said seat frame on said main frame, said support track comprising a first member affixed to said main frame and a second member affixed to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame; and locking means for securing said seat frame in relation to said main frame in a plurality of positions between said retracted position and said extended position, said locking means comprises (i) a plate mounted on said seat frame, said plate comprising a plurality of spaced slots, (ii) an arm pivotally mounted on said main frame and adapted to engage in said slots and, (iii) biasing means for urging said arm to one end position in relation to said main frame in order to engage one of said slots.

7. The unit of claim 6 wherein said locking means further comprises a means for moving said arm away from said plate to allow a movement of at least one of said first rail and said second rail in relation to said arm.

8. A seating unit with a movable seat section comprising:

a mainframe arranged for support of a backrest;

a seat frame for supporting a seat;

a support track for movably supporting said seat frame on said main frame, said support track comprising a first member secured to said main frame and a second member secured to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame; and locking means for securing said seat frame in relation to said main frame in a plurality of positions between said retracted position and said extended position, said locking means comprises(i) a plate mounted on said seat frame, said plate comprising a plurality of spaced slots, (ii) an arm pivotally mounted on said main frame and adapted to engage said slots and, (iii) biasing means for urging said arm to one end position in relation to said main frame in order to engage one of said slots.

9. The unit of claim 8 wherein said locking means further comprises a means for moving said arm away from said plate to allow a movement of said rail in relation to said arm.

10. The unit of claim 9 wherein said means for moving comprises:

a cable having a first end secured to said arm and a second end; and, an actuation means to which said cable second end is secured.

11. A seating unit with a movable seat section, comprising:

a main frame arranged for support of a backrest;

a stationary backrest affixed to said main frame;

a movable seat frame for supporting a seat, said seat frame being independently movable with respect to said backrest;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame and thereby lengthening an effective length of said movable seat section, said effective length being the distance between said backrest and a forward edge of said seat frame; and, locking means for securing said seat frame in relation to said main frame in a plurality of positions between said retracted position and said extended position, wherein said seat frame can be moved from a retracted position, in which a rear edge of said seat is located behind a front edge of said backrest, to an extended position in which said rear seat edge is located in front of said backrest front edge.

12. The unit of claim 11 wherein said first member of said support track comprises a first slide member mounted on said main frame along one side of said seat frame, and wherein said second member of said support track comprises a second slide member mounted on said seat frame and located parallel to and adjacent to said first slide member so that said second slide member can cooperate with said first slide member.

13. The unit of claim 11 wherein said first member of said support track comprises a first glide track mounted on said main frame, and wherein said second member of said support track comprises a second glide track mounted on said seat frame and located adjacent said first glide track so that said second glide track can cooperate with said first glide track.

14. The unit of claim 11 wherein said seat frame is oriented at an acute angle in relation to a horizontal plane in all positions of said seat frame.

* * * * *